US010166760B2

(12) United States Patent
Sato et al.

(10) Patent No.: US 10,166,760 B2
(45) Date of Patent: Jan. 1, 2019

(54) DROPLET EJECTION CONTROL APPARATUS, DROPLET EJECTION CONTROL METHOD, AND DROPLET EJECTION APPARATUS

(71) Applicant: SEIKO EPSON CORPORATION, Tokyo (JP)

(72) Inventors: Akito Sato, Nagano (JP); Naoki Sudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 15/467,177

(22) Filed: Mar. 23, 2017

(65) Prior Publication Data

US 2017/0282539 A1 Oct. 5, 2017

(30) Foreign Application Priority Data

Apr. 1, 2016 (JP) ..... 2016-074042

(51) Int. Cl.
*B41J 2/21* (2006.01)
*B41J 2/045* (2006.01)

(52) U.S. Cl.
CPC ..... *B41J 2/04505* (2013.01); *B41J 2/04586* (2013.01); *B41J 2/2132* (2013.01); *B41J 2/2139* (2013.01)

(58) Field of Classification Search
CPC .... B41J 2/04505; B41J 2/2132; B41J 2/2139; B41J 2/2142; B41J 2/0451; B41J 2/16579; B41J 2/2052; B41J 2/2054; B41J 2/2121
See application file for complete search history.

(56) References Cited

U.S. PATENT DOCUMENTS

2003/0174187 A1* 9/2003 Greive ..... B41J 2/2114 347/43
2006/0256157 A1* 11/2006 Kim ..... B41J 2/2139 347/47
2007/0030307 A1* 2/2007 Jeong ..... B41J 2/2139 347/47
2015/0283804 A1 10/2015 Sato et al.
2015/0283822 A1 10/2015 Fukazawa et al.
2015/0298454 A1 10/2015 Fukazawa et al.

FOREIGN PATENT DOCUMENTS

JP 2006-168104 A 6/2006
JP 2015-196340 A 11/2015
JP 2015-199251 A 11/2015
JP 2015-199252 A 11/2015
JP 2015-205442 A 11/2015

* cited by examiner

*Primary Examiner* — Julian D Huffman
*Assistant Examiner* — Scott A Richmond

(57) ABSTRACT

Provided is a droplet ejection control apparatus that causes a droplet ejection apparatus including a head in which a plurality of nozzles are disposed being aligned in a predetermined direction to perform overlap printing in which printing is duplicated in a predetermined region using a first nozzle row group and a second nozzle row group, and includes a control unit which sets an amount of droplets, when a predetermined condition is satisfied, to a value corresponding to the stated condition based on print control data according to which the first nozzle row group and the second nozzle row group perform superimposition printing.

8 Claims, 11 Drawing Sheets

| DOT SIZE | | PLAIN PAPER DYE | GLOSSY PAPER PIGMENT |
|---|---|---|---|
| S | S | M | L |
| S | M | M | L |
| M | M | L | L |

DROPLET EJECTION CONTROL APPARATUS, DROPLET EJECTION CONTROL METHOD, AND DROPLET EJECTION APPARATUS

BACKGROUND

1. Technical Field

The present invention relates to droplet ejection control apparatuses, droplet ejection control methods, and droplet ejection apparatuses configured to perform overlap printing in which printing is duplicated in a predetermined region.

2. Related Art

When printing is performed by ejecting ink droplets, overlap printing in which printing is duplicated in a predetermined region is performed. In a line head printer, a plurality of separate printing heads are so disposed as to partially overlap each other. In a multi-pass type serial head printer, a region of overlap printing is generated by making an amount of paper transport be shorter than a length of a nozzle row of the printing head.

JP-A-2006-168104 discloses a technique such that, in the case where a nozzle incapable of correctly ejecting droplets is generated in a multi-pass type serial head printer, another nozzle for printing on the same raster that the above incorrect ejection nozzle prints on is sought and is made to eject the droplets as a complementary nozzle. This makes it possible to substitute the sought nozzle for the nozzle incapable of correctly ejecting droplets, thereby preventing failure printing.

SUMMARY

According to the above-described existing technique, operation taken as a substitution measure is such that the nozzle originally expected to eject droplets is replaced with a nozzle not expected to eject droplets and the droplets are ejected through the latter nozzle. However, in the case where the droplets are planned to be ejected on the same raster, a desired print result will not be obtained because the droplets are ejected only through one nozzle.

An advantage of some aspects of the invention is to make it possible to obtain a desired print result in overlap printing.

An aspect of the invention is a droplet ejection control apparatus that causes a droplet ejection apparatus including a head in which a plurality of nozzles are disposed being aligned in a predetermined direction to perform overlap printing in which printing is duplicated in a predetermined region using a first nozzle row group and a second nozzle row group. The droplet ejection control apparatus is so constituted as to include a control unit that sets an amount of droplets, when a predetermined condition is satisfied, to a value corresponding to the stated condition based on print control data according to which the first nozzle row group including a nozzle incapable of normally ejecting droplets and the second nozzle row group perform superimposition printing.

With this structure, the droplet ejection control apparatus causes the droplet ejection apparatus including a head in which a plurality of nozzles are disposed being aligned in a predetermined direction to perform overlap printing in which printing is duplicated in a predetermined region using the first nozzle row group and the second nozzle row group. In the case of a line head printer, nozzle rows respectively provided in separate heads correspond to the first nozzle row group and the second nozzle row group. In the case of a serial head printer, a nozzle row in the same head, before and after the medium transport, corresponds to the first nozzle row group and the second nozzle row group.

As such, processed are the droplets that are ejected in the superimposition printing using the first nozzle row group including a nozzle incapable of normally ejecting droplets and the second nozzle row group. In other words, the aspect of the invention deals with a case in which, although the droplets are expected to be ejected on the same position through both the first and second nozzle row groups, one of the nozzle row groups includes a nozzle incapable of normally ejecting droplets. Based on the print control data prepared for the superimposition printing, the control unit sets the amount of droplets, when a predetermined condition is satisfied, to a value corresponding to the stated condition.

Here, a nozzle incapable of correctly ejecting droplets is included in the first nozzle row group or the second nozzle row group. Needless to say, the invention can be applied not only to a case of such a single incorrect ejection nozzle being present as described above, but also applied to a case of a plurality of incorrect ejection nozzles being present. Further, the above-described incorrect ejection nozzle may be present not only in the first nozzle row group but also present in the second nozzle row group, or may be present in both the nozzle row groups.

The nozzle incapable of normally ejecting droplets is not limited to a nozzle completely incapable of ejecting droplets, and may be a nozzle that ejects a smaller amount of droplets (ejection amount) than expected.

According to another aspect of the invention, the control unit may be so configured as to determine a predetermined amount of droplets based on the amount of droplets ejected by the first nozzle row group and the amount of droplets ejected by the second nozzle row group.

With this configuration, the control unit determines, in accordance with the print control data prepared for the superimposition printing, a predetermined amount of droplets based on the amount of droplets ejected by the first nozzle row group and the amount of droplets ejected by the second nozzle row group.

BRIEF DESCRIPTION OF THE DRAWINGS

The invention will be described with reference to the accompanying drawings, wherein like numbers reference like elements.

FIG. 13 is a diagram illustrating a UI (user interface) through which a complementary dot size is specified.

FIG. 14 is a diagram illustrating a table in which a conversion size can be changed in accordance with media, ink types, and the like.

DESCRIPTION OF EXEMPLARY EMBODIMENTS

First Embodiment

Hereinafter, an embodiment of the invention will be described with reference to the drawings.

Figure 1:
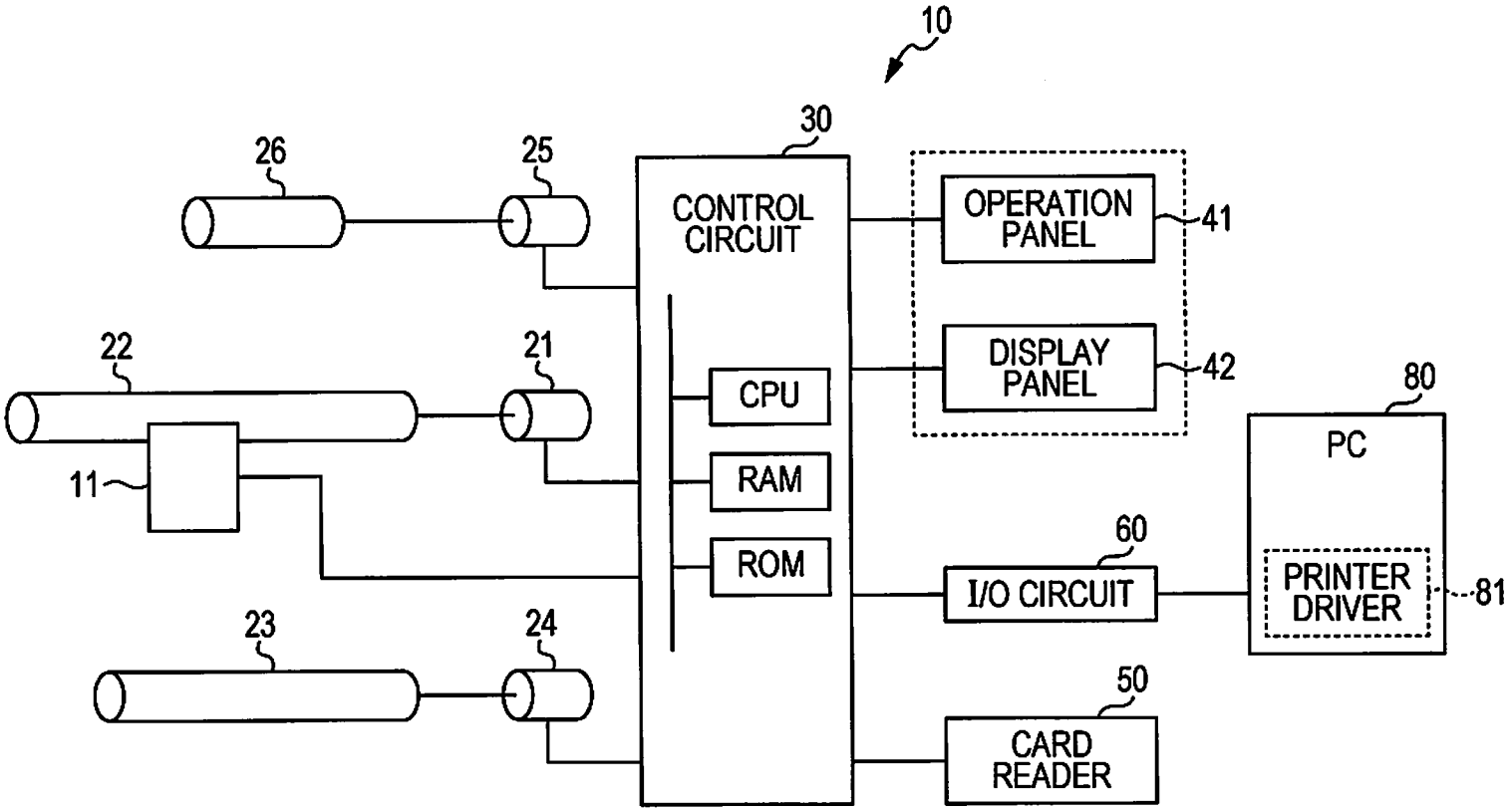
FIG. 1 is a block diagram illustrating a general configuration of a serial printer.

FIG. 1 is a schematic block diagram of an ink jet printer to which the invention is applied.

In FIG. 1, a printing head (head) 11 of a printer (droplet ejection apparatus) 10 ejects color inks of four or six colors, which are supplied from ink tanks, through nozzles. The printing head 11 is so driven as to move back and forth in a predetermined range by a belt 22 driven by a carriage motor 21. A platen 23 is driven by a platen motor 24 and transports paper in response to the reciprocating movement of the printing head 11. A feed motor 25 drives a feed roller 26 for supplying paper that is stored in a predetermined paper stacker. The printer of this type in which the printing head 11 moves back and forth in accordance with the transport of paper in the manner described above, is called a serial printer.

A control circuit 30 is configured by combining dedicated ICs so as to include a CPU, a ROM, and a RAM in terms of functionality. The control circuit 30 controls the driving of the printing head 11, the carriage motor 21, the platen motor 24, and the feed motor 25. An operation panel 41 and a display panel 42 are attached to the control circuit 30. The operation panel 41 receives predetermined operations by a user, and the display panel 42 displays predetermined representations thereon. The above hardware configuration is collectively referred to as a printing mechanism.

A card reader 50 is connected to the control circuit 30, which makes it possible, by mounting an attachable/detachable memory card, to read in the data stored in the memory card, record predetermined data, and so on. Further, an I/O circuit 60 is connected to the control circuit 30, thereby making it possible to connect with other external devices through wire or wireless communications. The control circuit 30 acquires an image data file from the external device, memory card, or the like, and executes printing based on the acquired data file while controlling the above-described constituent elements. Note that the control circuit 30 is connected to an external PC 80 through the I/O circuit 60. The PC 80 generates predetermined print control data using an internal printer driver 81 and sends the generated data to the control circuit 30.

Figure 2:
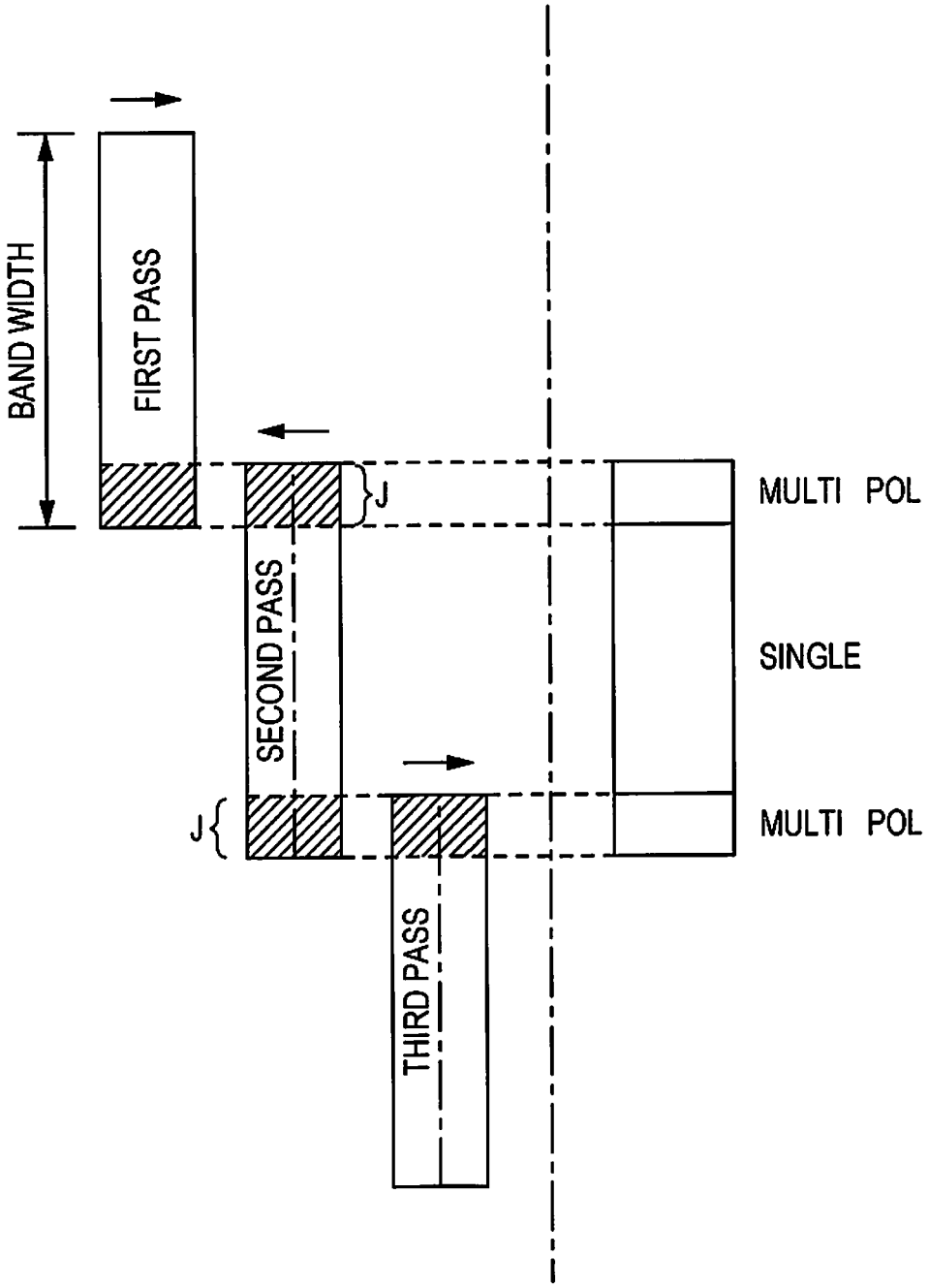
FIG. 2 is a diagram illustrating a region where overlap printing is performed by a serial printer.

FIG. 2 is a diagram illustrating a state of overlap printing.

When printing is performed by making the printing head 11 scan back and forth, there is a case in which a black stripe or a white stripe appears in a portion where print passes overlap with each other.

FIG. 2 illustrates overlapping states of the regions where printing is performed by a nozzle row of the printing head 11 in a first pass in which the printing is performed while the printing head 11 moving from left to right, a second pass in which the printing is performed while the head moving from right to left, and a third pass in which the printing is performed while the head moving from left to right, respectively.

Nozzles are formed in a row pattern in the printing head 11, and a range in which printing can be performed using the nozzles from the first one to the last one in a row is called a band width. In multi-pass printing, the printing is performed using a predetermined number of nozzles on the upstream side and a predetermined number of nozzles on the downstream side of the nozzle row in the printing head 11. In this example, printing is performed in a connection portion J in each print pass, that is, the multi-pass printing is performed in the connection portion J. The region in which the multi-pass printing is performed is referred to as an overlap region POL, and portions other than the overlap region POL are referred to as a normal portion in which single-pass printing is performed. By performing the multi-pass printing in the region to which the predetermined number of nozzles on the upstream side and the predetermined number of nozzles on the downstream side of the nozzle row correspond, the portion where the print passes overlap with each other has a width even if the printing is performed by making the printing head 11 scan back and forth, whereby a black stripe and a white stripe are unlikely to appear.

The nozzle row in a predetermined region on the downstream side of the printing head 11 in the first pass corresponds to a first nozzle row group, and the nozzle row in a predetermined region on the upstream side of the printing head 11 in the second pass corresponds to a second nozzle row group. The first nozzle row group and the second nozzle row group perform printing in the overlap region. Here, to perform printing in the same print region by the first nozzle row group and the second nozzle row group facing the stated region is referred to as "to perform duplicate printing". Meanwhile, printing performed such that ink droplets are ejected, on a dot-position by dot-position basis, on the same dot position in accordance with the print control data is referred to as "superimposition printing".

The nozzles may be formed being aligned in a single row or formed being arranged in a zigzag (staggered) pattern. In any case, the nozzles are arranged being aligned in a predetermined direction.

Figure 3:
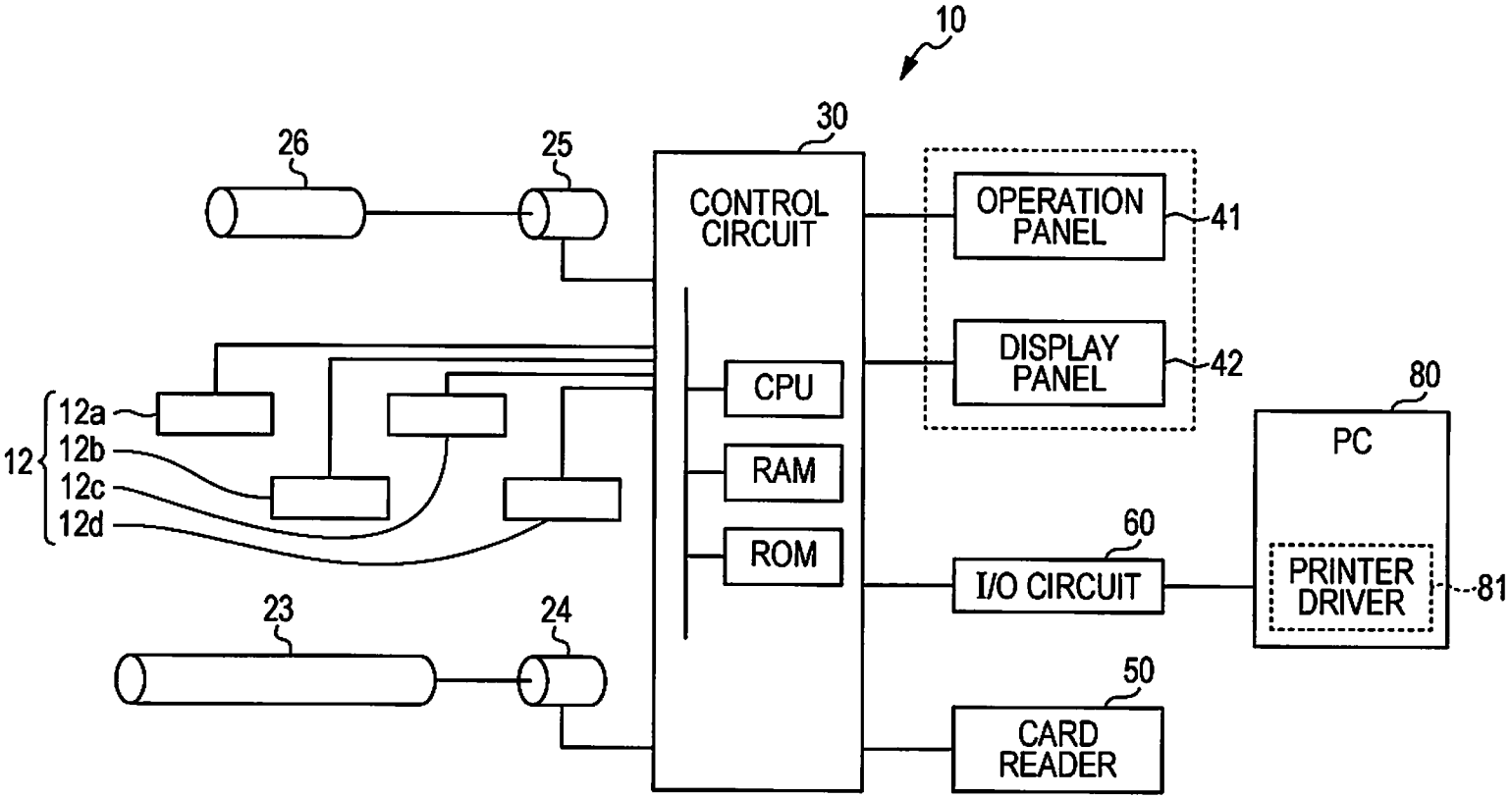
FIG. 3 is a block diagram illustrating a general configuration of a line printer.

FIG. 3 is a schematic block diagram of another ink jet printer to which the invention is applied. This ink jet printer includes printing heads 12 (12*a*-12*d*), and an alignment direction of the nozzle rows is orthogonal to a paper transport direction. The printing heads 12*a* to 12*d* are arranged in a zigzag pattern so that end portions of the band widths thereof partially overlap with each other. In comparison with the serial printer shown in FIG. 1, although the carriage motor 21, the belt 22, and the like for moving the printing head 12 are unnecessary, the nozzles are required to be positioned across a width of print paper and the plurality of printing heads 12 are necessary. This type of ink jet printer is also referred to as a line printer.

Figure 4:
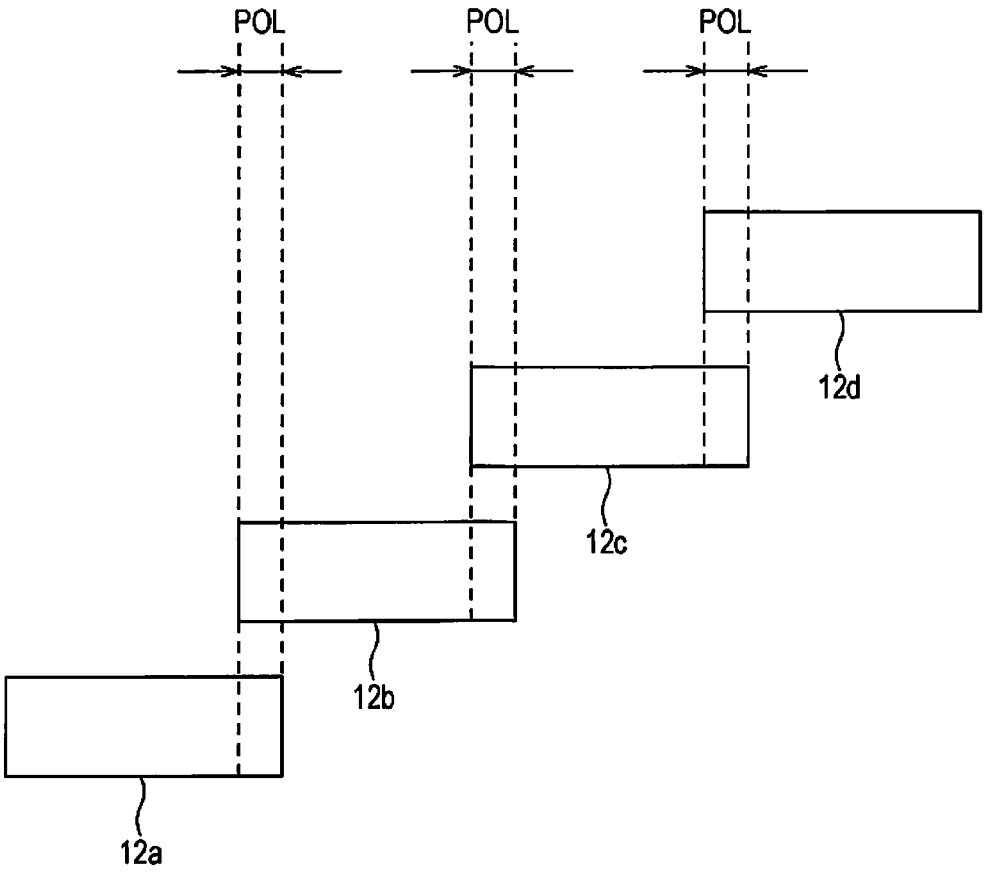
FIG. 4 is a diagram illustrating a region where overlap printing is performed by a line printer.

FIG. 4 is a diagram illustrating a state of overlap printing of the line printer.

Although, in reality, the printing heads 12 are arranged in a zig-zag pattern, they are illustrated in FIG. 4 as being arranged in a step-like pattern so as to facilitate the understanding of overlap printing. In the line printer, the plurality of printing heads 12 are so arranged in advance as to overlap with each other at the end portions of the respective band widths thereof. With this, overlap printing is performed in a portion where the printing heads 12 permanently overlap with each other. As shown in the drawing, each of sections where the printing heads 12 overlap with each other is an overlap region POL. In this example, although the overlap region is generated at the end portion of the band width, a section where the overlap region is generated is not limited to any specific one. As such, an overlap region may be generated in any section. In addition, in the case where multi-pass printing is also performed a plurality of times in the same print region in the line printer through the paper transport control, an overlap region is consequently generated in a section where the multi-pass printing is performed.

In an example of the line printer, since the print heads 12 are so arranged as to overlap with each other at the end portions of the band widths thereof, a nozzle row at one end portion of a certain printing head 12 corresponds to a first nozzle row group, while a nozzle row at one end portion of another printing head 12 at a position overlapping with the first nozzle row group corresponds to a second nozzle row group. The first nozzle row group and the second nozzle row group perform printing in the overlap region. Also in this case, to perform printing in the same print region by the first nozzle row group and the second nozzle row group facing the stated region is referred to as "to perform duplicate printing". Meanwhile, printing performed such that ink droplets are ejected, on a dot-position by dot-position basis, on the same dot position in accordance with the print control data is referred to as "superimposition printing".

In the case of a serial printer, the overlap region POL is generated due to a position shift of a raster printed during the two-time scanning of the printing head 11, or the like, which is caused by inappropriate paper transport, a variation in precision of the impact position of droplets ejected from the printing head 11, or the like. Meanwhile, in the case of a line printer, a position shift of the raster occurs due to a variation in positioning precision when fixing the printing head 12 in the manufacturing. Because the time of manufacturing process becomes long, special instruments are needed, and so on to enhance the positioning precision, a certain level of positioning precision is permitted according to the manufacturing cost.

Figure 5:
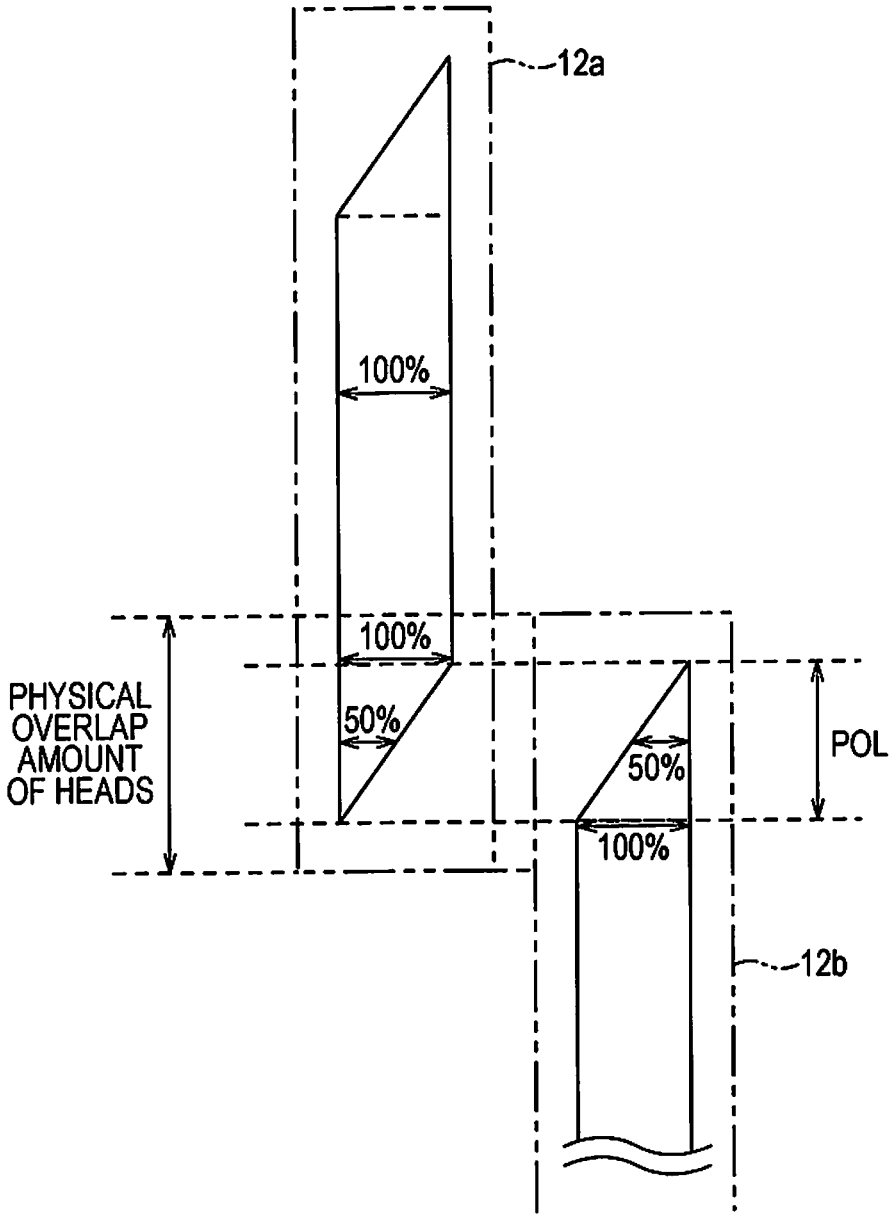
FIG. 5 is a diagram illustrating a sharing ratio of ejection amounts of each head in a region where overlap printing is performed.

FIG. 5 is a diagram illustrating a sharing ratio of ejection amounts of each head in a region where overlap printing is performed.

FIG. 5 illustrates nozzle positions and a data assignment state of the corresponding raster data. Although the same explanation can be given to a serial printer and a line printer, the description will be given taking a line printer as an example for the sake of convenience. A double-dot dash line indicates a physical position of the printing head 12; as shown in the drawing, two printing heads 12*a* and 12*b* overlap with each other at the end portions of the respective band widths. Although a length of the nozzle row is shorter than a length of the physical printing head 12, the overlap region POL is generated by the printing heads 12 partially overlapping with each other. In a case where raster data in the overlap region is printed by both the printing heads 12, printing is duplicated. This state is expressed as "a droplet ejection amount is 200%". In a case where printing is performed by only one of the printing heads 12, the droplet ejection amount is 100%. However, this is not a state of overlap printing. As such, the overlap printing of the raster data is performed while the printing operation being shared between the printing heads 12*a* and 12*b*.

In a normal region, which is not the overlap region, the droplet ejection amount is 100%. However, in the overlap region POL, the sum total of ejection amounts is set to a value exceeding 100% so as to reduce a white stripe that can be generated depending on the positioning precision. Mask patterns representing ON/OFF flags are prepared in advance in order to obtain a predetermined sharing ratio of ejection amounts in accordance with respective raster data, the mask patterns are superimposed on the raster data having experienced halftone processing, and then the raster data corresponding to the ON flags is supplied to the printing heads 11, 12. As a result, the desired sharing ratio of ejection amounts can be realized. There are cases in which the ON/OFF flags in the mask patterns are randomly formed, the sum total of ejection amounts exceeds 100%, and a dot is assigned to a dot position where another dot is assigned on the print control data, which causes superimposition printing. The expression "on the print control data" means that, although actual dot positions are shifted due to various types of problems of positioning precision, the positions are intended to be identical.

Hereinafter, a generation process of raster data will be described.

Figure 6:
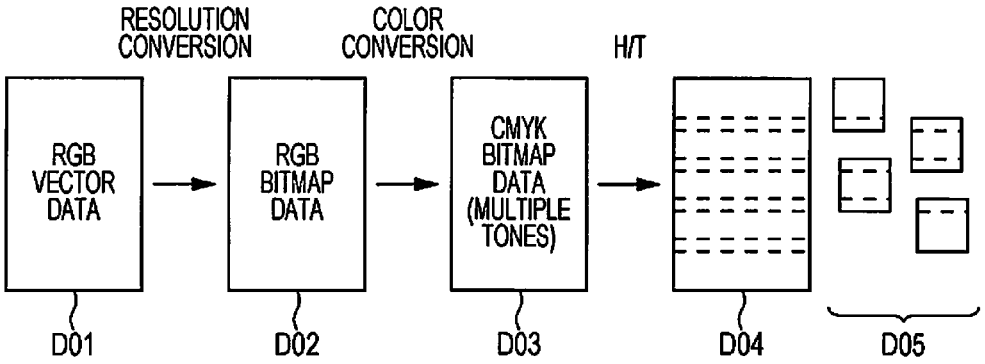
FIG. 6 is a diagram illustrating an example of data conversion.

FIG. 6 is a diagram illustrating an example of data conversion.

In the case where printing is performed using a PC 80, an application of the PC 80 generally handles RGB multiple-tone data. Although vector data, bitmap data, and the like can be handled, vector data D01 is taken as an example herein. In the printing process, first of all, the vector data D01 is converted to RGB multiple-tone bitmap data D02 corresponding to the printer resolution. This is referred to as a resolution conversion.

Although various kinds of inks such as inks of four colors or inks of six colors are mounted in the printer, inks of four colors of CMYK are taken as an example of the inks mounted herein. The RGB multiple-tone bitmap data D02 is converted to CMYK multiple-tone bitmap data D03 corresponding to the ink colors of the printer. This is referred to as a color conversion. The color conversion is carried out while referring to a color conversion lookup table. After the color conversion, although the bitmap data D03 corresponds to the ink colors, it is still in the form of multiple tones. Accordingly, carried out is halftone processing in which the multiple-tone data is converted to binary data representing whether or not to eject a droplet, or converted to multivalued data of two bits additionally corresponding to the size of the droplet. With this, the bitmap data D03 is converted to raster data D04 corresponding to the respective nozzles. With the multivalued data of two bits, the following are represented: "00" refers to no ejection, "01" refers to an S-size ejection, "10" refers to an M-size ejection, and "11" refers to a complementary size ejection, which will be explained later.

Being such raster data that corresponds to the respective nozzles of the printing heads 12, the raster data D04 can be formed in raster data D05 in which the raster data D04 is divided into pieces of data corresponding to each of the printing heads 12 while including the overlap regions. At this time, with regard to the overlap regions, the raster data is assigned to each of the printing heads within a predetermined range of the droplet ejection amount. Because the droplet ejection amounts are shared between the printing heads, in the case where the raster data D05 assigned to one of the printing heads 12 is not assigned to the other of the printing heads 12, the sum total of the droplet ejection amounts becomes 100%. In the case where the sharing ratio is set so that the sum total exceeds 100% in the embodiment, droplets will be ejected from both the printing heads 12 for a certain dot.

Figure 7:
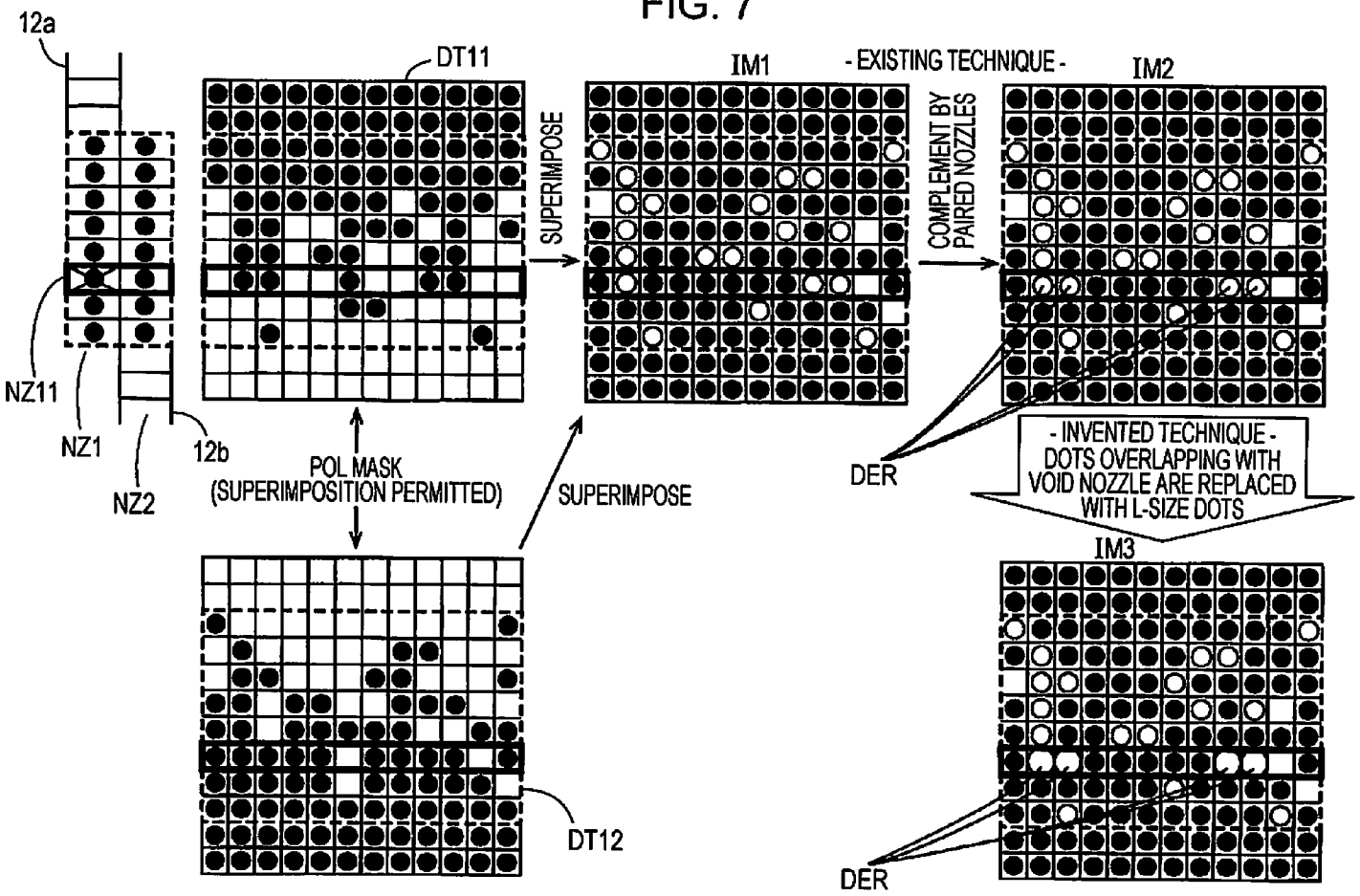
FIG. 7 is a diagram illustrating a printing state in an overlap region.

FIG. 7 illustrates a printing state in an overlap region.

A nozzle row NZ1 is a nozzle row of the first printing head 12 while a nozzle row NZ2 is a nozzle row of the second printing head 12, and end portions of the respective nozzle rows overlap with each other as discussed above. Raster data DT11 is print control data supplied to the nozzle row NZ1 while raster data DT12 is print control data supplied to the nozzle row NZ2, and each black circle therein indicates assignment of a dot. An image IM1 is a dot image obtained through overlap printing. In the drawing, each white circle indicates dots ejected by both the nozzle rows NZ1 and NZ2.

Here, it is assumed that a nozzle NZ11 in the nozzle row NZ1 is a void nozzle. In other words, the nozzle NZ11 is a nozzle incapable of normally ejecting ink droplets due to some trouble. The incident that an ink droplet is not ejected through the nozzle NZ11 results in the generation of an image IM2, which is a dot image obtained through overlap printing. Dots DER originally expected to be ejected by both the nozzle rows NZ1 and NZ2 are ejected only through a nozzle of one of the nozzle rows NZ1 and NZ2, which makes the image IM2 differ from the image IM1. A situation where the number of ejected dots is smaller means that the ejection amount is lessened. This raises a problem that an expected density cannot be obtained, because the printing is performed based on a previously calculated ejection amount. Note that an image IM3 is a dot image obtained through complementary processing of the invention, which will be explained later.

Figure 8:
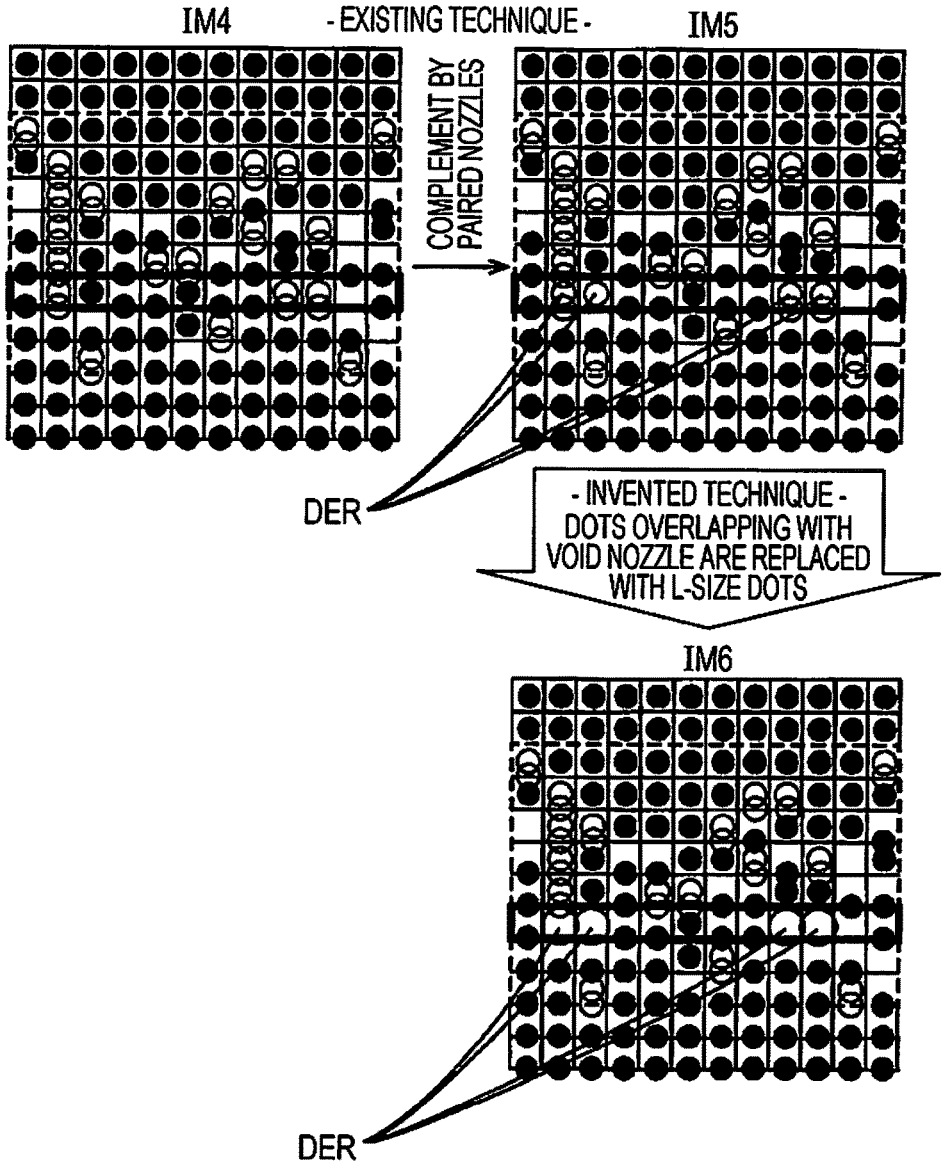
FIG. 8 is a diagram illustrating a printing state in an overlap region in a case where there is a problem of positioning precision.

Next, FIG. 8 illustrates a printing state in an overlap region in a case where there is a problem of positioning precision.

Performing the superimposition printing in the overlap region is aimed at reducing the influence of position shifts of the printing heads 12, in addition to adjusting the density. In the case where a position shift occurs, a section in which dots cannot be closely aligned without a gap is generated. This makes a white stripe likely to appear. To deal with this issue, dots of superimposition printing are provided so that a white stripe is unlikely to appear even if the printing head 12 is shifted in position. As depicted in an image IM4, gaps generated in places can be filled with the dots of superimposition printing.

Note that, however, if a single nozzle NZ11 in the nozzle row NZ1 is also a void nozzle, a dot image obtained through overlap printing becomes an image IM5. The dots DER originally expected to be ejected by both the nozzle rows NZ1 and NZ2 are ejected only through a nozzle of one of the nozzle rows NZ1 and NZ2, which makes the image IM5 differ from the image IM4. A situation where the number of ejected dots is smaller means that the dots to fill the gaps generated due to the position shift are lessened. This raises a problem that a while stripe conspicuously appears, because the arrangement of the dots of superimposition printing is determined based on the calculation in advance in order to prevent the white stripe from conspicuously appearing. Note that an image IM6 is a dot image obtained through complementary processing of the invention, which will be explained later.

Figure 9:
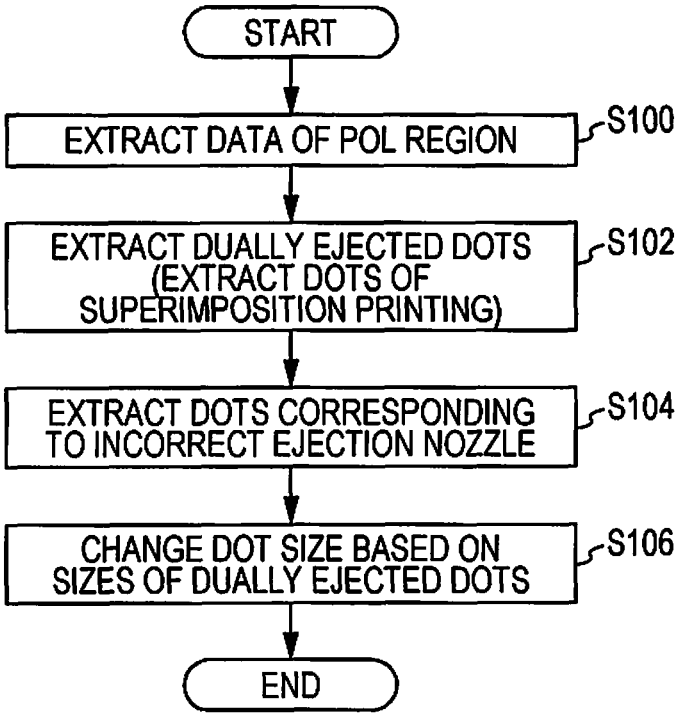
FIG. 9 is a diagram illustrating a flowchart of a printing process to which the invention is applied.

FIG. 9 illustrates a flowchart of a printing process to which the invention is applied.

This printing process is carried out in accordance with raster data. Although the process is executed by the printer driver 81 of the PC 80, it can also be executed by the control circuit 30 in the printer 10. The CPU configured to execute a predetermined program carries out the process following the flowchart. As such, the PC 80, the control circuit 30, or the like substantially corresponds to a control unit of the droplet ejection control apparatus.

The CPU first extracts data of an overlap region POL in S100. The stated data corresponds to the raster data DT11 and DT12 shown in FIG. 7. Next, dots ejected by both the nozzle rows are extracted in S102. In other words, the dots of superimposition printing are extracted. In S104, from among the dots of superimposition printing, dots corresponding to an incorrect ejection nozzle are extracted.

The incorrect ejection nozzle can be specified by various types of methods. For example, a predetermined driving signal is supplied to an actuator of each nozzle, and whether or not each of the nozzles is an incorrect ejection nozzle can be determined in accordance with a residual signal waveform at this time. Further, in the case where several dots are ejected from each of the nozzles in sequence while transporting the paper, a step-like diagram is depicted. However, if a discontinuous portion is generated in the diagram, it can also be understood that an incorrect ejection nozzle is present at a position corresponding to the discontinuous portion. In the case of automatic detection, the above-mentioned information on the incorrect ejection nozzle can be registered in the printing head 12 itself. It is also possible to manually register information on the incorrect ejection nozzle by a check pattern being printed.

When the information on the incorrect ejection nozzle is obtained, the dot size is changed in S106, with reference to sizes of dually ejected dots of the raster data corresponding to the dots of superimposition printing including the dot of the incorrect ejection nozzle. A situation where the sizes of dually ejected dots of the raster data corresponding to the dots of superimposition printing match a combination of dot sizes set in a table, corresponds to a situation where a predetermined condition is satisfied; and changing the dot size corresponds to setting the amount of droplets to a value corresponding to the stated condition. In the raster data, as discussed above, the S-size or M-size is specified as a dot size. The combinations of the dually ejected dots are any one of "SS", "SM", and "MM".

The incorrect ejection nozzle is not limited to only a single one that is included in the nozzle row NZ1 or NZ2. A plurality of incorrect ejection nozzles may be included in the nozzle rows NZ1, NZ2; in this case, the incorrect ejection nozzles may be included not only in one of the nozzle rows NZ1 and NZ2, but also be included in both the nozzle rows. The invention can be applied not only to a nozzle completely incapable of ejecting droplets, but also applied to a nozzle that ejects a smaller amount of droplets than expected.

Figure 10:
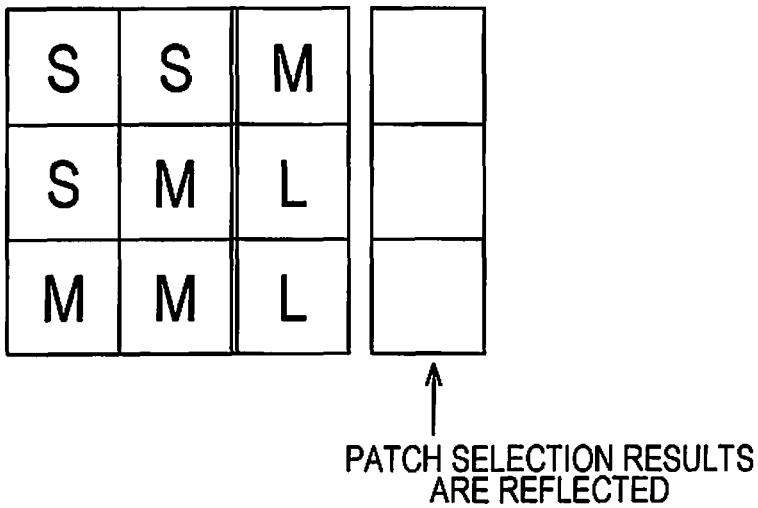
FIG. 10 is a diagram illustrating a table in which indicated are sizes of dots that are converted based on sizes of dually ejected dots.

FIG. 10 illustrates a table in which indicated are sizes of the dots that are converted based on the sizes of the dually ejected dots.

The M-size is a size that is converted corresponding to the combination of SS, the L-size is a size that is converted corresponding to the combination of SM, and the L-size is also a size that is converted corresponding to the combination of MM. The L-size refers to a large size dot that is formed such that the driving signals for ejecting M-size droplets are supplied to the printing heads 12 at a short time interval, whereby the M-size ink droplets are combined in the air to be formed on the paper as a large size dot.

Each conversion size brings a dot equal to or slightly larger in size than the dot of the combination of the original dots. In other words, in the case where an incorrect ejection occurs in one of the nozzles for dually ejected dots, a more larger dot is made by the conversion.

As discussed above, because the dot size corresponds to the amount of droplets, a predetermined amount of droplets to be converted is determined based on the amount of droplets ejected by the first nozzle row group and the amount of droplets ejected by the second nozzle row group.

In addition, because a more larger droplet is made by the conversion, a more larger amount of droplets is determined based on the amount of droplets ejected by the first nozzle row group and the amount of droplets ejected by the second nozzle row group.

The operation in which a larger dot is made by the conversion and printed as discussed above results in the generation of the image IM3 shown in FIG. 7 and the image IM6 shown in FIG. 8. The dots DER expected to be ejected by both the nozzle rows NZ1 and NZ2 are dually ejected dots DER, which have an effect to reduce a change in density by the dots becoming larger in the case of the image IM3, and also have an effect to suppress the conspicuous appearance of a white stripe by the dots becoming larger so as to fill the gaps in the case of the image IM6.

Although, in this embodiment, overlap printing is performed using the first nozzle row group and the second nozzle row group, overlap printing is not necessarily limited to the case where the second nozzle row group is used. In the case of a serial head printer, overlap printing of a larger number of times can be performed depending on the paper transport. Even in the case of a line head printer, overlap printing can be performed a larger number of times depending on the paper transport.

Second Embodiment

FIG. 10 illustrates the table in which indicated are the sizes of dots that are converted based on the combinations of the original dot sizes. However, the sizes of dots to be converted are not limited thereto. In the second embodiment, optimum conversion sizes are selected in accordance with an actual print environment.

Figure 11:
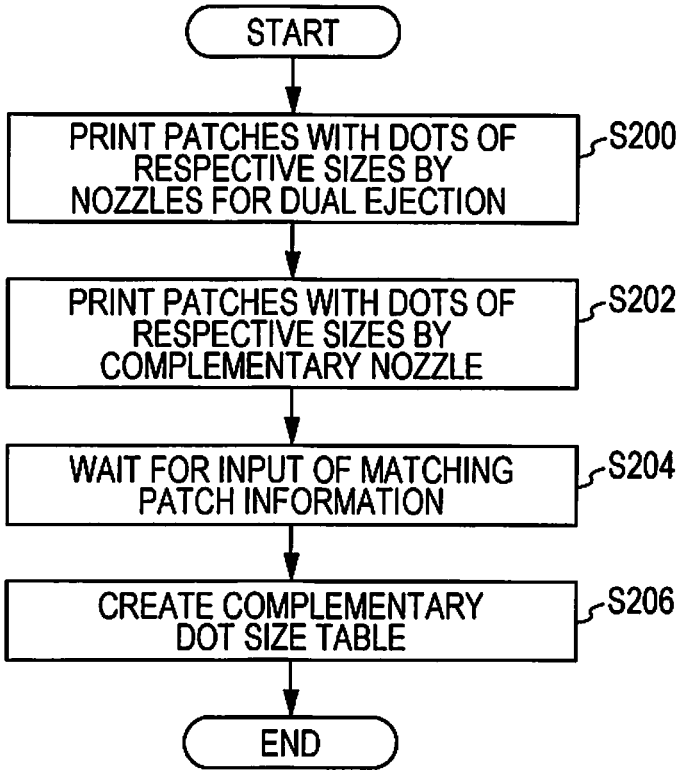
FIG. 11 is a diagram illustrating a flowchart to determine a conversion size.
Figure 12:
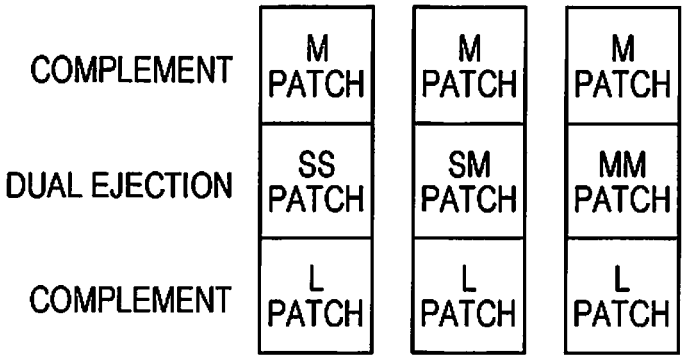
FIG. 12 is a diagram illustrating patches to be printed.
Figures 13, 14:
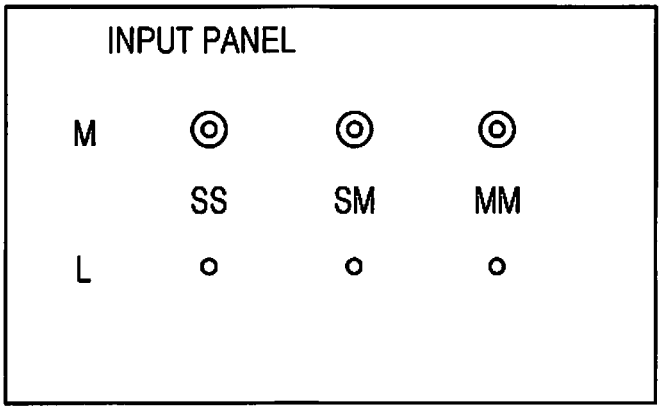

FIG. 11 illustrates a flowchart to determine a conversion size. FIG. 12 illustrates patches to be printed. FIG. 13 illustrates a UI (user interface) through which a complementary dot size is indicated.

In the embodiment, in S200, patches are printed first with dots of respective sizes by nozzles for dual ejection. Subsequently, in S202, patches are printed with dots of respective sizes by a complementary ejection nozzle.

As shown in FIG. 12, three combinations of patches are printed. In the center of each combination, overlap printing is performed assigning an S-size dot to each of two combinations of the nozzle rows. In this case, superimposition printing is performed. The superimposition printing may be performed across the overall region, or may be performed in a manner in which only one nozzle ejects droplets at a certain rate and the superimposition printing is carried out at a certain rate. The patches are printed in the original state where no incorrect ejection nozzle is generated.

Two patches in which dot sizes corresponding to the dots of superimposition printing are changed are printed so as to sandwich the above-mentioned center patch. As shown in the drawing, the patch in which the dot is converted to the M-size one is printed on the upper side, and the patch in which the dot is converted to the L-size one is printed on the lower side. Likewise, patches in which the dots are converted to the M-size ones are printed on the upper side and patches in which the dots are converted to the L-size ones are printed on the lower side corresponding to all of the combinations of dot sizes of the nozzles for dual ejection.

A user looks at the above-discussed print result and specifies a patch closer to the center patch through the UI (user interface) as shown in FIG. 13. Following actual patch arrangement, the user selects one of the patches printed on the upper and down sides across the three rows in a lateral direction. Input of matching patch information is awaited in S204, and a complementary dot size table is created in S206 based on the inputted result. That is, although the rightmost column of the table in FIG. 10 is vacant, it is sufficient to reflect complementary nozzle dot sizes matching all of the combinations of the dot sizes of the nozzles for dual ejection.

In the step of S200, color patches that have experienced superimposition printing with predetermined amounts of droplets by the first nozzle row group and the second nozzle row group are printed as the center patches. In the step of S202, a plurality of color patches in which the amounts of droplets have been changed in one of the first nozzle row group and the second nozzle row group are printed as the patches on the upper and lower sides. In the step of S204, input that specifies one of the plurality of color patches printed by one of the first nozzle row group and the second nozzle row group is received. In the step of S206, the amount of droplets of the color patch specified by the input having been received in S204 is set in the table as an amount of droplets that is determined based on the amount of droplets ejected by the first nozzle row group and the amount of droplets ejected by the second nozzle row group.

As such, the steps of S200 and S202 correspond to a color patch printing section, the step of S204 corresponds to a specifying section, and the step of S206 corresponds to a droplet amount determination section.

In this embodiment, droplets for assigning the S-size and M-size dots are ejected by the first nozzle row group and the second nozzle row group; however, in the case of ejecting of droplets for assigning dots of further different sizes, it is sufficient that patches in which sizes of the droplets ejected by the complementary nozzle are changed corresponding to the color patches of the respective combinations are printed so that a patch with a smaller difference can be selected therefrom. Further, the layout of the patches is not limited to the layout of the embodiment in which the patches are printed on the upper side and the lower side. Because a user is influenced by colors of patches in some case, it is also possible that the patches are printed in a plurality of colors so that the user can select an adequate patch based on his or her comprehensive judgement. Furthermore, it is also possible that the colors are divided into groups and sizes of the dots to be converted are varied corresponding to each group.

Third Embodiment

According to the second embodiment, optimum conversion sizes can be obtained under an operation environment of each user. Note that, however, conversion sizes can be adjusted in a simplified manner using information of the operation environment.

FIG. 14 illustrates a table in which conversion sizes can be changed in accordance with media, ink types, and the like. For example, while taking the conversion sizes indicated in FIG. 10 as default values, the table of conversion sizes can be changed corresponding to the case of plain paper in which bleeding is likely to occur and the case of glossy paper in which bleeding is unlikely to occur as examples of the media. In the case of plain paper in which bleeding is likely to occur, when a combination of dually ejected dot sizes is SM, not the L-size but the M-size is selected in consideration of the bleeding likely to occur. Meanwhile, in the case of glossy paper in which bleeding is unlikely to occur, even when a combination of dually ejected dot sizes is SS, not the M-size but the L-size is selected in consideration of the bleeding unlikely to occur.

This example corresponds to an example in which a predetermined amount of droplets is determined based on types of the media, the amount of droplets ejected by the first nozzle row group, and the amount of droplets ejected by the second nozzle row group.

Likewise, taking dye in which bleeding is likely to occur and pigment in which bleeding is unlikely to occur as examples of the types of droplets, the table of conversion sizes can be changed. In the case of dye in which bleeding is likely to occur, when a combination of dually ejected dot sizes is SM, not the L-size but the M-size is selected in consideration of the bleeding likely to occur. Meanwhile, in the case of pigment in which bleeding is unlikely to occur, even when a combination of dually ejected dot sizes is SS, not the M-size but the L-size is selected in consideration of the bleeding unlikely to occur.

This example corresponds to an example in which a predetermined amount of droplets is determined based on types of the droplets, the amount of droplets ejected by the first nozzle row group, and the amount of droplets ejected by the second nozzle row group.

It is needless to say that the invention is not limited to the above embodiments. It goes without saying, for those skilled in the art, that the following are included as embodiments of the invention:

the invention is applied in a manner in which the combinations of the members, configurations, and so on that are disclosed in the aforementioned embodiments are capable of being replaced with each other and appropriately changed.

the invention is applied in a manner in which members, configurations, and so on, although not disclosed in the aforementioned embodiments, that are known techniques and can replace or can be replaced with the members, configurations, and so on disclosed in the aforementioned embodiments, are appropriately employed for the replacement, and the combination thereof is changed.

the invention is applied in a manner in which members, configurations, and so on, although not disclosed in the aforementioned embodiments, that can be considered, by those skilled in the art based on the known techniques and the like, to be capable of being used as substitutes for the members, configurations, and so on disclosed in the aforementioned embodiments, are appropriately employed for the replacement, and the combination thereof is changed.

This application claims priority under 35 U.S.C. § 119 to Japanese Patent Application No. 2016-074042, filed Apr. 1 2016. The entire disclosure of Japanese Patent Application No. 2016-074042 is hereby incorporated herein by reference.

What is claimed is:

1. A droplet ejection control apparatus that controls a droplet ejection apparatus including a head in which a plurality of nozzles are aligned in a predetermined direction to perform overlap printing in which printing is duplicated in a predetermined region using first and second nozzle row groups of the nozzles, the droplet ejection control apparatus comprising:

a control unit that sets an amount of droplets that are ejected relative to a predetermined dot position in the predetermined region by one of the first and second nozzle row groups, when a predetermined condition is satisfied, to a value corresponding to the predetermined condition based on print control data while the print control data indicates superimposition printing, in which printing at a dot position is performed using both the first and second nozzle row groups, at the predetermined dot position in the predetermined region, and while the other one of the first and second nozzle row groups includes a nozzle that corresponds to the predetermined dot position in the predetermined region and is incapable of normally ejecting droplets.

2. A droplet ejection control apparatus that causes a droplet ejection apparatus including a head in which a plurality of nozzles are disposed being aligned in a predetermined direction to perform overlap printing in which printing is duplicated in a predetermined region using a first nozzle row group and a second nozzle row group, the droplet ejection control apparatus comprising:

a control unit that sets an amount of droplets, when a predetermined condition is satisfied, to a value corresponding to the predetermined condition based on print control data according to which the first nozzle row group including a nozzle incapable of normally ejecting droplets and the second nozzle row group perform superimposition printing, wherein the control unit determines a predetermined amount of droplets based on the amount of droplets ejected by the first nozzle row group and the amount of droplets ejected by the second nozzle row group.

3. The droplet ejection control apparatus according to claim 2, wherein the control unit determines a larger amount of droplets based on the amount of droplets ejected by the first nozzle row group and the amount of droplets ejected by the second nozzle row group.

4. The droplet ejection control apparatus according to claim 2, wherein the control unit determines a predetermined amount of droplets based on types of droplets, the amount of droplets ejected by the first nozzle row group, and the amount of droplets ejected by the second nozzle row group.

5. The droplet ejection control apparatus according to claim 2, wherein the control unit determines a predetermined amount of droplets based on types of media, the amount of droplets ejected by the first nozzle row group, and the amount of droplets ejected by the second nozzle row group.

6. The droplet ejection control apparatus according to claim 2, wherein the control unit includes a color patch printing section that prints color patches having experienced superimposition printing with predetermined amounts of droplets by the first nozzle row group and the second nozzle row group as well as a plurality of color patches in which the amounts of droplets have been changed in one of the first nozzle row group and the second nozzle row group; a specifying section that receives input specifying one of the plurality of color patches printed by one of the first nozzle row group and the second nozzle row group; and a droplet amount determination section that takes the amount of droplets of the color patch specified by the input having been received in the specifying section as an amount of droplets that is determined based on the amount of droplets ejected by the first nozzle row group and the amount of droplets ejected by the second nozzle row group.

7. A droplet ejection control method that controls a droplet ejection apparatus including a head in which a plurality of nozzles are aligned in a predetermined direction to perform overlap printing in which printing is duplicated in a predetermined region using first and second nozzle row groups of the nozzles, the method comprising:

setting an amount of droplets that are ejected relative to a predetermined dot position in the predetermined region by one of the first and second nozzle row groups, when a predetermined condition is satisfied, to a value corresponding to the predetermined condition based on print control data while the print control data indicates superimposition printing, in which printing at a dot position is performed using both the first and second nozzle row groups, at the predetermined dot position in the predetermined region, and while the other one of the first and second nozzle row groups includes a nozzle that corresponds to the predetermined dot position in the predetermined region and is incapable of normally ejecting droplets.

8. A droplet ejection apparatus that includes a head in which a plurality of nozzles are aligned in a predetermined direction to perform overlap printing in which printing is duplicated in a predetermined region using first and second nozzle row groups of the nozzles, the apparatus comprising:

a control unit that sets an amount of droplets that are ejected relative to a predetermined dot position in the predetermined region by one of the first and second nozzle row groups, when a predetermined condition is satisfied, to a value corresponding to the predetermined condition based on print control data while the print control data indicates superimposition printing, in which printing at a dot position is performed using both the first and second nozzle row groups, at the predetermined dot position in the predetermined region, and while the other one of the first and second nozzle row groups includes a nozzle that corresponds to the predetermined dot position in the predetermined region and is incapable of normally ejecting droplets.

* * * * *